United States Patent [19]

Eigenmann

[11] 4,129,673

[45] Dec. 12, 1978

[54] SNOWPLOWING RESISTING ROAD SURFACE MARKING TAPE MATERIAL

[76] Inventor: Ludwig Eigenmann, Vacallo, Ticino, Switzerland

[21] Appl. No.: 787,072

[22] Filed: Apr. 13, 1977

[30] Foreign Application Priority Data

Apr. 15, 1976 [IT] Italy ..... 22352 A/76
Dec. 24, 1976 [IT] Italy ..... 30886 A/76

[51] Int. Cl.[2] ..... E01F 9/04

[52] U.S. Cl. ..... 428/172; 404/9; 428/156; 428/913

[58] Field of Search ..... 428/40, 156, 167, 168, 428/172, 323, 325, 327, 343, 354, 913; 404/9, 12, 14, 19; 350/102, 103, 105, 106, 109

[56] References Cited

U.S. PATENT DOCUMENTS 3,418,896 12/1968 Udeout ..... 404/14
3,485,148 12/1969 Heenan ..... 404/12
3,996,556 12/1976 Eigenmann ..... 404/14
4,035,059 7/1977 DeMaster ..... 404/9

*Primary Examiner*—Stanley S. Silverman
*Attorney, Agent, or Firm*—Michael J. Striker

[57] ABSTRACT

An improved roadway surface marking tape material of the kind provided with retroreflective elements or other visibility and/or anti-skid improving elements, upwardly protruding over the generally planar upper face of the tape, the new tape being improved by the provision of further protruding components secured to said upper layer, of height over said face, greater than that of such elements, and comprising sloping portions, for raising snowplowing implements passing over the marking, and causing such implement to slide above said elements, without interfering with the same and therefore protecting them against the destructive action of said snowplowing means.

11 Claims, 11 Drawing Figures

Fig. 8
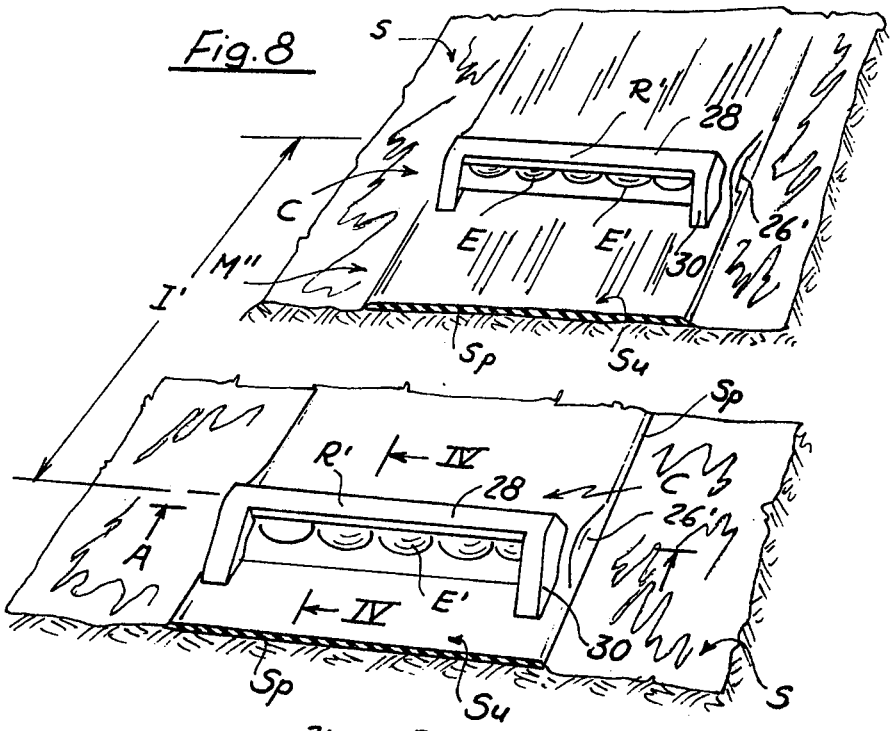
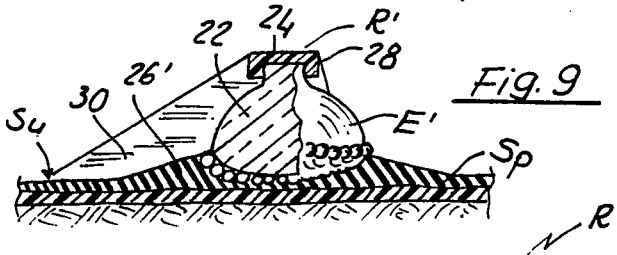
Fig. 9
Fig. 10
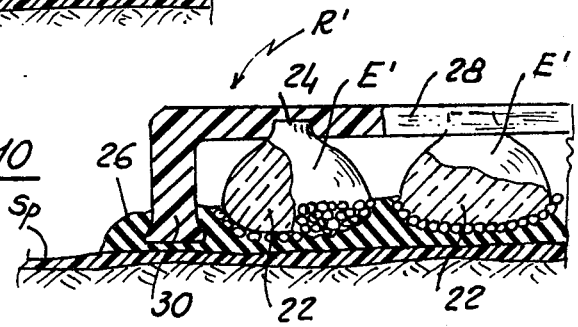
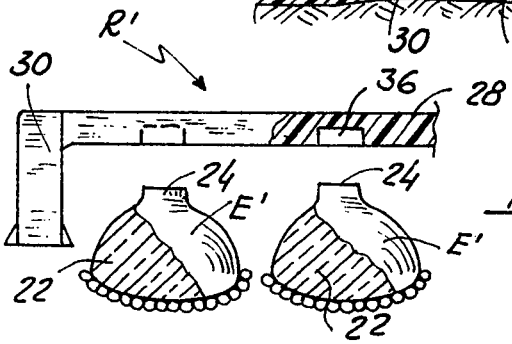
Fig. 11

SNOWPLOWING RESISTING ROAD SURFACE MARKING TAPE MATERIAL

BACKGROUND OF THE INVENTION

1. Field of the Invention

The present invention is concerned with road surface marking for traffic regulation, that is with forming, on the upper face of roadways and other areas open to vehicle traffic, traffic regulating signs, such as roadways center-lines, traffic lane dividing lines, roadway edge lines, pedestrian crossing marking strips and so on.

More particularly, this invention is concerned with forming said surface markings or signs by selectively positioning on and fixedly securing to the upper face of roadways (and corresponding roadable areas) prefabricated tape materials which, in service, will form portions of the roadable area, said tape materials being of the kind provided with retroreflective elements partially embedded into or otherwise secured to the upper traffic wear resisting layer thereof, for improving nighttime visibility of the marking.

2. Description of the Prior Art

The art of producing and applying such tape material is a well worked one and wide patent literature thereabout exists. Recently developed and improved tape materials provided with highly efficient retroreflective elements have been described, for example, in the U.S. Pat. No. 3,781,083 (British Pat. No. 1,367,240 and German Patent Application P 22 34 384.6), U.S. Pat. No. 3,935,365 (British Pat. No. 1,463,681 and German Patent Application P 24 03 398.5), U.S. Pat. No. 3,981,557 (British Pat. No. 1,443,618 and German Patent Application P 24 41 491.3) and other, all of the Inventor of the present invention.

Very broadly speaking, the retroreflectivity, that is the nighttime visibility at distance, upon retroreflection of the light emitted by the vehicles headlamps, is grossly proportional to the sharp upwardly jutting out the elements above upper surface of the signalling tape material.

It is evident that the compounding and the manufacture of said roadway surface marking tape materials take into consideration the wear and the severe abuse of vehicle traffic and the stresses which are unavoidably applied by the vehicle passage thereover, in particular during positive and negative accelerations and even during an emergency braking. An extremely destructive action is however exerted by the passage of snowplowing machines and vehicles, in particular of the type provided with snow flangers or blades designed and positioned for exert a somewhat doctoring action for scraping off and displacing away the snow layer from the road pavement surface. Those skilled in the art are well aware that no sharply protruding retroreflective element of the type referred to above can resist to the scraping action of said snow removing means or, conversely, the entire tape material can be stripped or torn off from the road surface by a snow scraper implement impinging on such protruding elements, if exceptionally firmly secured to the tape material.

It is therefore an object of this invention to provide a new and improved roadway surface marking tape material which is substantially not prejudiced or affected by the passage and action of currently used snowplowing machines, and therefore capable of maintaining efficiency and nighttime visibility during wintertime or in any case when the weather requires even repeated snowplowing of the road surface.

SUMMARY OF THE INVENTION

The new tape material according to the invention, which comprises a wear and traffic resisting upper layer having an upper surface and a plurality of elements including retroreflective elements and upwardly protruding above the plane defined by said surface, is essentially characterized by the fact that it has further upwardly protruding components secured to said upper layer, said further components being of height over said plane greater than that of the highest of said elements and being of such configuration to define, either individually or in their combination and arrangement on the tape, a support and slide surface over which the snow engaging lower edge portion of the snowplowing means are supported and caused to slide above said protruding elements to prevent impingement thereon.

The said snowplowing means slidably supporting components are provided with slanting surfaces forming a slope on and along which the snowplowing means can be gradually and essentially effortlessly caused to run up to the level above the protruding elements to be protected against impingement, where the said snowplowing means engage the tape material during the travel and snowplowing service.

According to a first embodiment of the invention, such components consists of essentially uninterrupted rails arranged parallel and essentially adjacent to the side edges of the tape material, and having sloping end portions at the end portions of the tape.

According to another embodiment of the invention, the road surface marking tape material has protruding elements, namely retroreflective elements, arranged in groups spaced along the length of the upper layer of the tape, and each group is individually protected from the destructive action of the passing snowplowing means by protective components bridging over said grouped elements and having sloping surfaces for raising said means above and over said elements.

These and other features of the invention and the service and advantages thereof will be made apparent from the following detailed description of some not limitative examples of embodiments thereof, and referred to the accompanying drawings.

BRIEF DESCRIPTION OF THE DRAWINGS

FIG. 8 is a perspective fragmentary and partly sectional view of another embodiment of the tape material including differently arranged and protected groups of retroreflective elements;

FIGS. 9 and 10 are enlarged, detailed and fragmentary sectional views of one group of the tape FIG. 8, taken is a vertical plane parallel to and respectively perpendicular to the side edges of the tape, and FIG. 11 is an exploded view of the structure of FIG. 10, prior to its assembling.

DESCRIPTION OF THE PREFERRED EMBODIMENTS

Figure 1:
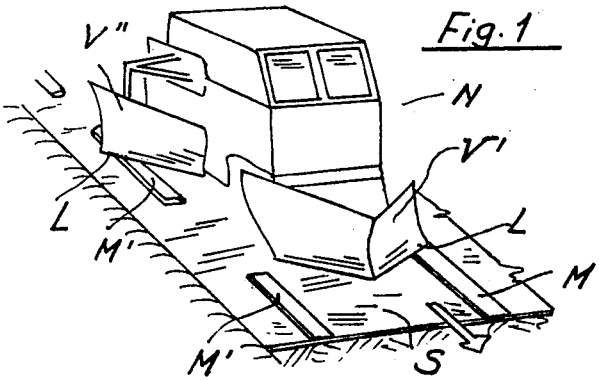
FIG. 1 is a diagrammatical perspective view of a conventional snowplowing machine operating on and along a roadway having traffic regulating strip markings consisting of tape material secured to the pavement thereof.
Figure 2:
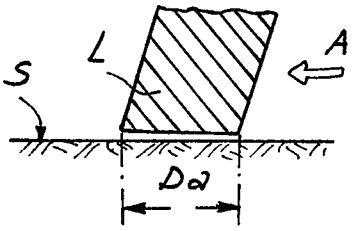
FIG. 2 is cross-sectional fragmentary enlarged view of the road surface grazing lower edge portion of any of the ploughshare snow removing means of the machine.

The scope and the advantages of the invention will be made more evident upon a consideration of FIG. 1: a conventional snowplowing apparatus comprises a motor driven vehicle such as that generally indicated at N, provided with snow parting and laterally displacing ploughshare means or snow flangers V', secured at the fore body of the vehicle, and seldom with complemental side flangers V''. Such plowing means are provided with a ground engaging lower edge portion L (details in FIG. 2) of proper cross-sectional configuration and of given thickness Da adapted for sliding on the surface S of the roadway pavement, for engaging the base of the snow layer laying and seldom pressed and/or frozen thereon. The operations of such implements do not generally effect an uniformly produced and smooth surface S.

This operation is however extremely destructive for road surface markings, such as traffic lane dividing strips M or edge defining strips M' (either continuous or discontinuous), in particular when such strips are formed by tape materials having an upper surface $S_u$ having elemenents E, principally retroreflective elements partly embedded within the mono- or multilayer structure $S_p$ (FIGS. 3 to 5 and 8 to 10) but substantially and sharply protruding or jutting above the generally planar upper face $S_u$ of the tape.

Figure 3:
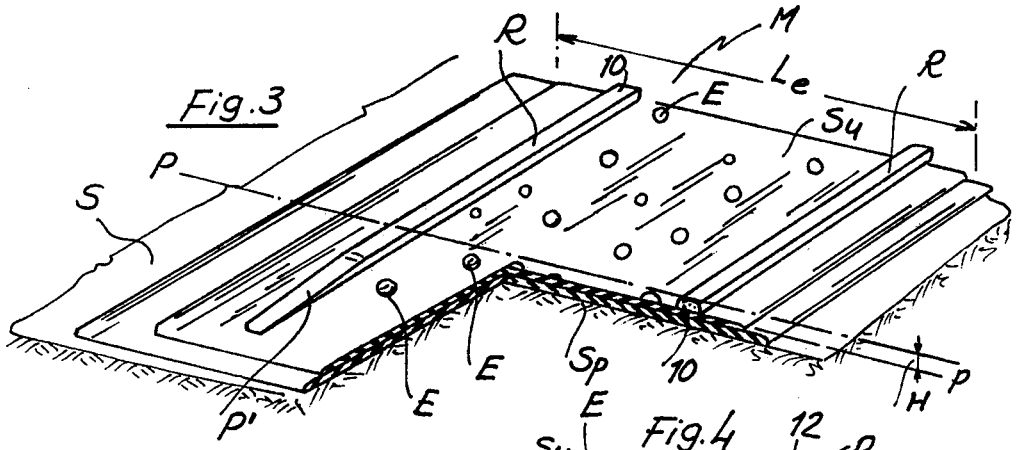
FIG. 3 is a perspective fragmentary view of an end portion of a marking tape constructed according to the invention.
Figure 4:
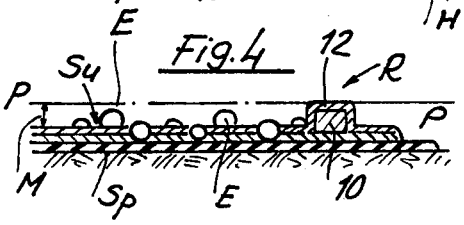
FIGS. 4 and 5 are fragmentary cross-sectional views of examples of the structure and arrangement of the components of the tape of FIG. 3.
Figure 5:
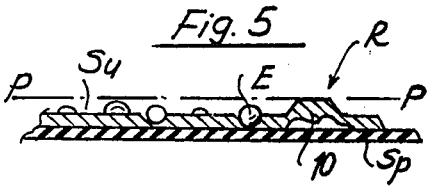

According to the embodiment of FIG. 3, the tape material M is provided with at least one and preferably two (or more) protruding components R (which can be compared to "rails") firmly secured to the tape structure $S_p$ and of height H (FIGS. 3 and 4) above the actual upper face $S_u$ of the tape, greater than the height or jutting up the generally highest elements E. The upper narrow and elongated face of said elements form a surface bearing the blade or blades L of the snowplowing means, which are, consequently, caused to run on a plane (the trace of which is indicated at P—P) spaced above the said upper face $S_u$ at said height H, thus passing above the elements E.

Preferably, said components or rails R are arranged lengthwise on the tape material M and spaced from each to other by a distance which is less than the actual width Le of the tape, that is noticeably inwardly of the very side edges of the tape.

At their end portions, the rails R are tapered to form sloping surfaces P' (FIG. 3) along which the snowplowing means can effortlessly slide and be progressively raised at the height H of the slide plane P—P above the elements E.

These rails or components R can be made of metal rods 10, such as of inox stainless steel), or with extruded plastics resisting to wear, friction and stresses, such as polyester, polyurethane, nylons and the like. The rods are firmly secured to the tape structure say by means of adhesives, solvents and the like. Said rails can also be made integral with the upper layer of the tape, such as by plastics extrusion process. Alternatively, the rails can comprise a pressure resistent core (FIG. 4) coated by a resin impregnated wear resisting fabric, which complements their connection to the tape structure. Same rails might have a tapered cross-sectional configuration (FIG. 5) and partially embedded into the tape upper layer to form a dove-tail connection.

Figure 6:
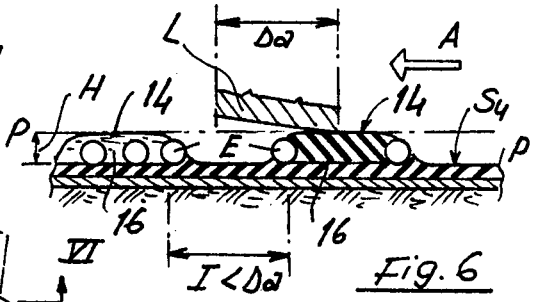
FIG. 6 is a fragmentary sectional view of a modified arrangement, taken along the plane indicated at VI—VI in FIG. 7, wherein retroreflective elements are grouped to form protruding structures arranged for slidably supporting a snow displacing means thereabove.
Figure 7:
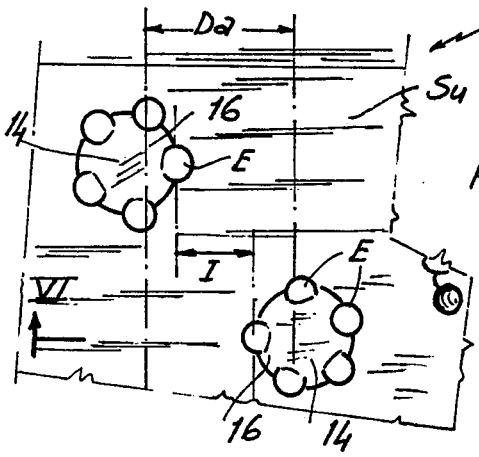

In view of a most complete protection of the elements against the tearing-off action of the snowplowing means (and of broken ice pieces carried along therewith), an arrangement such as shown in FIGS. 6 and 7 can provide a valuable contribution. Such arrangement comprises grouping each plurality of elements E about a stress and wear resistant resinous body 16 having a flat upper surface 14, said groups being arranged on the surface $S_u$ of the tape at spacings I (in the direction A in which the snowplowing implement is assumed to travel on the road) less than the said width $D_a$ of the lower road engaging edge portion of the implements.

The embodiment shown in FIGS. 8 to 11 consists of road surface marking tape material M'' provided with grouped hidhly efficient upwardly protruding transversely elements. This embodiment is particularly but not exclusively advantageous for ensuring the visibility at distance of highways edge lines and other traffic dividing lines which are generally assumed to be not crossed by the vehicles. Retroreflective elements E' each having a sharply protruding dome or part-spherically shaped protruding portion and a generally flattened lower portion having reflectorized retrocollimating beads secured thereto (these features do not form part of the present invention), are grouped in rows extended transversally of the tape at proper intervals I' therealong.

Each group is formed and arranged to form an unitary retroreflective device including said elements and means for protecting same against the destructive action of snowplowing implements, each device being generally indicated at C and its protective component at R' (as being alternative to the rails R of FIG. 3). Said component R' is transversally arranged on the tape surface $S_u$ and bridges above the row of elements E'. It comprises a cross bar or beam 28 having recesses 36 into which neck portions 24 can be engaged and secured for improving the rigidity and the resistance of the device. The said beam 28 is integrally formed with side or leg portions 30 having foot portions adapted to be partially embedded into and secured to the upper layer $S_u$ of the tape, suitably locally thickened as indicated at 26 (FIG. 9) and at 26' (FIG. 10) for best connection with the said protective component R' and respectively with the lower portions of the elements E'.

During the operation of the snowplowing, the snow parting and displacing implements thereof pass successively above the various device C by upwardly sliding along sloping surfaces formed by the same side portions 30 of the protective component R'. One slope is illustrated in FIG. 9. The said sloping surfaces can be formed and arranged in one direction only (as shown) on the premise that a snowplowing machine will travel in one given direction only, when in service, but the said side portions 30 can be however provided with symmetrical slopes for facilitating the passage of the snowplowing machine in both directions, such as in two-way rather narrow mountain or country roadways.

I claim:

1. A prefabricated pavement marking tape, comprising a unitary structure including an elongated tape portion securable to a pavement and having a substantially planar traffic-wear resistant upper surface; a plurality of retroreflective elements each having a lower section embedded in said tape portion and an upper section projecting above said upper surface of said tape portion to a predetermined height; and at least one uninterrupted rail portion extending lengthwise of the direction of elongation of said tape portion and being free of said retroreflective elements, said rail portion being provided on said upper surface of said tape portion and projecting upwardly therefrom to a height exceeding the predetermined height to which said upper sections of said retroreflective elements project, so as to protect said tape portion and said upper sections of said retroreflective elements against impingement of and damage by a snowplow.

2. The tape of claim 1, said rail portion having a trapezoidal cross-section and having upwardly and inwardly inclining sides.

3. The tape of claim 1, said rail portion having a metal core and a wear-resistant resin coating, and extending along the entire length of said tape portion.

4. The tape of claim 1, further comprising an additional rail portion, both rail portions extending longitudinally along said tape portion and being transversely spaced from each other by a distance at most equal to the distance between two ends of a snowplow blade, said additional rail portion also being fixed to said upper surface of said tape portion in such a manner that said additional rail portion projects above said predetermined height, said multiplicity of retroreflective elements being between said rail portions.

5. The tape of claim 4, said rail portions being parallel to each other.

6. The tape of claim 4, each of said rail portions having a bevelled upper face.

7. The tape of claim 4, each of said rail portions being positioned along and adjacent to a respective one of the side edges of said tape portion.

8. The tape of claim 4, said rail portions each having a cross-sectional configuration upon which a snowplow blade is slideable, and each being made from a material which is non-malleable and non-ductile at temperatures to which a road surface will be subjected.

9. The tape of claim 4, said rail portions being integral with said portion tape.

10. The tape of claim 4, each respective rail portion having two opposite end portions each of which is upwardly sloped in the direction of the center of the respective rail portion.

11. The tape of claim 10, said rail portions being symmetrically sloped.

* * * * *